United States Patent [19]

Chibana

[11] 4,227,433

[45] Oct. 14, 1980

[54] ELECTRONIC MUSICAL INSTRUMENTS

[75] Inventor: Masanobu Chibana, Hamamatsu, Japan

[73] Assignee: Nippon Gakki Seizo Kabushiki Kaisha, Hamamatsu, Japan

[21] Appl. No.: 76,561

[22] Filed: Sep. 18, 1979

[51] Int. Cl.[3] ..... G10H 1/06; G10H 7/00

[52] U.S. Cl. ..... 84/1.01; 84/1.03; 84/1.22

[58] Field of Search ..... 84/1.01, 1.03, 1.11, 84/1.19, 1.22

[56] References Cited

U.S. PATENT DOCUMENTS

| | | | |
|---|---|---|---|
| 3,992,971 | 11/1976 | Chibana et al. | 84/1.03 X |
| 4,036,096 | 7/1977 | Tomisawa et al. | 84/1.01 |
| 4,085,644 | 4/1978 | Deutsch et al. | 84/1.01 |
| 4,111,090 | 9/1978 | Deutsch | 84/1.01 |
| 4,127,047 | 11/1978 | Tomisawa | 84/1.01 |
| 4,130,043 | 12/1978 | Niimi | 84/1.03 |
| 4,133,241 | 1/1979 | Niimi et al. | 84/1.01 |
| 4,135,424 | 1/1979 | Okamoto | 84/1.03 X |
| 4,138,915 | 2/1979 | Nagai et al. | 84/1.22 |
| 4,142,432 | 3/1979 | Kameyama et al. | 84/1.01 |
| 4,183,275 | 1/1980 | Niimi et al. | 84/1.01 |

*Primary Examiner*—S. J. Witkowski

*Attorney, Agent, or Firm*—Thompson, Birch, Gauthier & Samuels

[57] ABSTRACT

An electronic musical instrument is of a waveshape memory read out type which includes a waveshape memory device for storing amplitude values at respective sampling points in one period of a new musical tone waveshape to be generated subsequent to a present musical tone waveshape stored in another waveshape memory device, first calculating means for calculating differences in amplitude values at respective sampling points stored in corresponding addresses of the two waveshape memory devices respectively; renewal rate control means for generating a waveshape renewal signal having a period corresponding to difference information produced by the first calculating means, and renewal means for effecting renewal of the memory content of said another waveshape memory device at a rate corresponding to the period of the waveshape renewal signal.

9 Claims, 5 Drawing Figures

ELECTRONIC MUSICAL INSTRUMENTS

BACKGROUND OF THE INVENTION

This invention relates to an electronic musical instrument, and more particularly an electronic musical instrument of the waveshape memory read out type.

As is well known in the art, an electronic musical instrument of the waveshape memory read out type is constructed to repeatedly read out sampling point amplitude values in one period of a musical tone waveshape stored in a waveshape memory device over a period corresponding to the tone pitch of a depressed key and then convert the read out sampling point amplitude values to corresponding analogue signals so as to produce a musical tone having a frequency corresponding to the tone pitch of the depressed key. Since the waveshape stored in the waveshape memory device corresponds to a specific tone color, it is impossible to change the tone color of the generated musical tone to another tones.

To solve this problem, one may prepare a plurality of waveshape memory devices respectively storing musical tone waveshapes corresponding to different tone colors and to switch these waveshape memory devices for producing musical tones of different tone colors. However, provision of a plurality of waveshape memory devices not only increases the cost but also increases the size of the instrument. In certain cases, some of the waveshape memory devices may not be used to that the efficiency of the memory devices is poor.

For this reason, it has been proposed to use a random access memory device (RAM) as the waveshape memory device, to write into the RAM a musical tone waveshape of a desired tone color and then sequentially read out the written content for generating a musical tone, as disclosed, for example, in U.S. Pat. No. 4,142,432, issued on Mar. 6, 1979.

In an electronic musical instrument of the type described above utilizing a RAM, that is of the type wherein the musical tone waveshapes are renewed or rewritten, if the content of the RAM is renewed quickly to a musical tone waveshape to be generated next time, noise in the form of clicks generates thus giving unpleasant feeling to the listeners. To solve this problem, in an electronic musical instrument disclosed in said patent, an interpolation is made for the purpose of removing click noise which generates at the time of renewal of the musical tone waveshape from old one to new one. More particularly, according to this system, at the time of renewal, a value which decreases gradually is multiplied to an old musical tone waveshape now being generated while a gradually increasing value is multiplied to a new musical tone waveshape to be generated next and the sum of the products is produced as a musical tone waveshape signal thus ensuring smooth renewal of the musical tone waveshape. This renewal system, however, not only requires a long arithmetical operation time, but also requires circuits for generating various timing pulses utilized to execute the arithmetic (multiplying) operation thereby complicating the circuit construction. In addition, in the electronic musical instrument described above, as the renewal rate of the musical tone waveshape is fixed, tone color changes rapidly at the time of renewal thus giving unnatural feeling to the listeners in some cases.

SUMMARY OF THE INVENTION

Accordingly, it is an object of this invention to provide a novel electronic musical instrument in which the renewal of the content of a waveshape memory device can be smoothly performed without utilizing a multiplier thereby to produce musical tones having various tone colors.

Another object of this invention is to provide an electronic musical instrument capable of setting the renewal rate as desired thus enabling to control the variation in the tone color at the time of renewal.

According to this invention there is provided an electronic musical tone instrument wherein a musical tone is generated by repeatedly reading out amplitude values at respective sampling points in one period of a musical tone waveshape stored in a first waveshape memory device at a period corresponding to a tone pitch of a depressed key, the electronic musical instrument comprising a second waveshape memory device for storing amplitude values at respective sampling points in one period of a new musical tone waveshape to be generated subsequent to the musical tone waveshape stored in the first waveshape memory device, a first calculating means for calculating differences in amplitude value at respective sampling points stored in corresponding addresses of the first and second waveshape memory devices respectively, renewal signal generating means for generating a waveshape renewal signal having a period corresponding to difference information produced by the first calculating means, and renewal means for effecting renewal of the memory content of the second waveshape memory device at a rate corresponding to the period of the waveshape renewal signal.

DESCRIPTION OF THE PREFERRED EMBODIMENT

Figure 1:
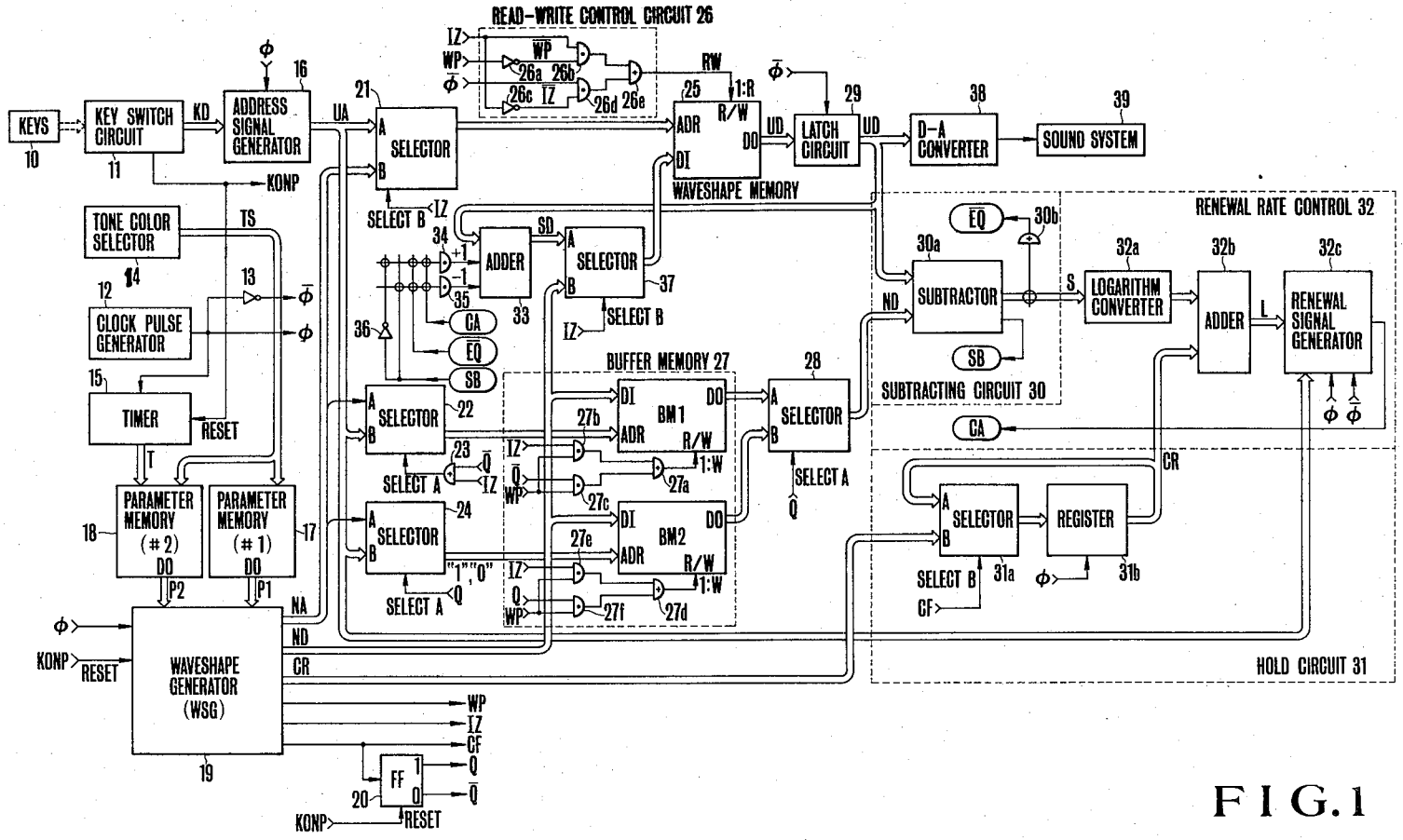
FIG. 1 is a block diagram showing one embodiment of an electronic musical instrument according to this invention.

A preferred embodiment of the electronic musical instrument of this invention shown in FIG. 1 comprises a key switch circuit 11 provided for a keyboard and comprising a plurality of key switches corresponding to respective keys 10. Thus, when a key is depressed a key switch corresponding thereto is operated to produce key information KD of a logical "1" on its output line as well as a key-on pulse KONP having a narrow width and showing that any one of the keys has been depressed. The electronic musical instrument is also provided with a clock pulse generator 12 which produces a clock pulse $\phi$ of a definite period, an inverter 13 which inverts the clock pulse $\phi$ to produce an inverted clock pulse $\overline{\phi}$, a tone color selector 14 for producing a tone color section signal TS (comprising a plurality of bits)

corresponding to the selected tone color, a timer 15 which is reset by the key-on pulse KONP to sequentially count thereafter the number of the clock pulses $\phi$ for producing its count value as a timer signal T, an address signal generator 16 which reads out a frequency information R corresponding to the key information KD from a frequency information memory device, not shown, storing at the respective addresses thereof the frequency information R corresponding to the tone pitches of the keys, the address signal generator 16 including means to sequentially accumulate the read out frequency information R each time a clock pulse is generated and then to apply an accumulated value q·R (q=1, 2, 3 . . . ) to a waveshape memory device 25 to be described later to act as an address signal UA for reading out a present musical tone waveshape now desired to be generated, and a first parameter memory device 17 which stores in its addresses parameter information P1 for calculating the musical tone waveshape. The content of the parameter memory device 17 is read out by being addressed by the color selecting signal TS. There is also provided a second parameter memory device 18 including memory blocks corresponding to timer signals T produced by the timer circuit 15. Each address of each memory block stores renewal rate correction information CR which corrects the renewal rate of new musical tone waveshape written into a waveshape memory device 25 from a buffer memory device 27 to be described later, waiting time information WT representing a waiting time between completion of a calculation of new musical tone waveshape information in a musical waveshape generator (WSG) 19 and a time at which the data (sampling point amplitude value) of the new musical tone waveshape is transferred to the buffer memory device 27, that is a time at which the musical tone waveshape in the waveshape memory device 15 is renewed, and parameter information PT which varies with time for calculation of the musical tone waveshape, all information stored in the addresses being encoded. The renewal rate correction information CR, the time-varying parameter information PT and the waiting time information WT are stored in respective memory blocks in the form of different values. The #2 parameter memory device 18 is addressed by the timer signal T and the color selecting signal TS to read out its memory contents (CR, PT, WT) which are produced as parameter information P2. Thus, the content of the parameter information P2 produced by the #2 parameter memory device 18 varies with time corresponding to the variation in the timer signal T. The renewal rate correcting information CR is expressed in terms of decibels, in other words, in terms of logarithms.

The musical tone waveshape calculating information P1 produced by the #1 parameter memory device 17 is information, for determining the fundamental waveshape for example a pitch, of the musical tone waveshape to be calculated in accordance with a selected tone color designated by the tone color selecting signal TS. On the other hand the time-varying parameter information PT produced by the #2 parameter memory device 18 is information, for example regarding tone color and volume, which is utilized to delicately vary with time the shape of the musical tone waveshape, and to vary with time the amplitude of the musical tone waveshape.

Figure 2:
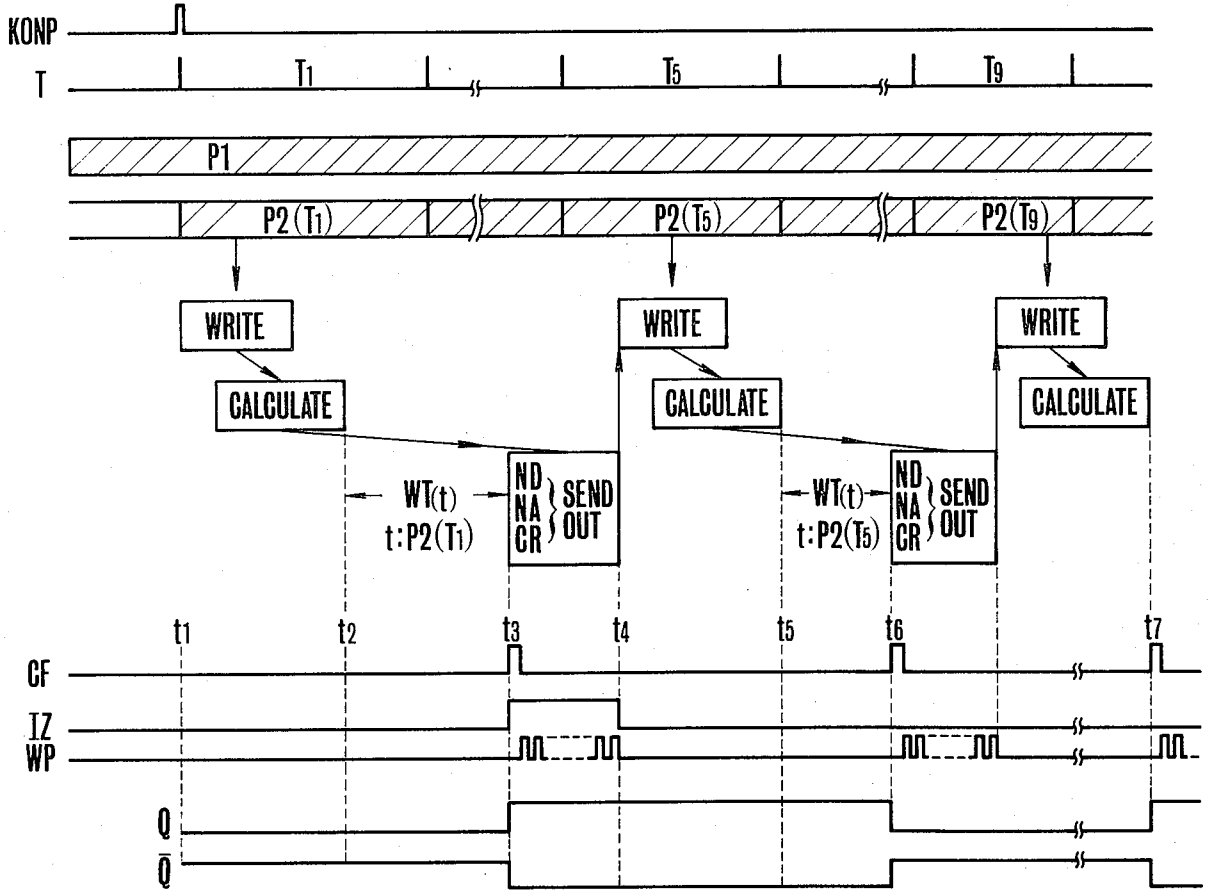
FIG. 2 is a graph useful to explain the operation of the musical tone waveshape generator shown in FIG. 1.

A musical tone waveshape generator (WSG) 19 is provided which is reset by a key-on pulse KONP and then calculates the sampling point amplitude value of a new musical tone waveshape based on the parameters P1 and P2 described above thereby producing the sampling point amplitude value as new musical tone waveshape data ND. This musical tone waveshape generator 19 has a construction similar to that disclosed in U.S. Pat. No. 4,085,644 dated Apr. 25, 1978, and generates data ND, together with an address signal NA representing the memory address of the data ND, a writing pulse WP (logical "1") and a calculation termination signal CF. At the time of completing the first new musical tone waveshape data ND immediately following the depression of a key, the musical tone waveshape generator 19 produces an initial signal IZ which is always a logical "1" during an interval between said termination of the calculation and the completion of the writing of the new musical tone waveshape data ND into the waveshape memory device 25 and the buffer memory device 27. Further, the musical tone waveshape generator 19 produces renewal rate correction information CR contained in the parameter information P2. As above described, the WSG 19 calculates a new musical tone waveshape based on the parameter information P1 and P2 and its process of calculation is shown in FIG. 2 which will be described later in connection with the operation of the electronic musical instrument.

A J-K flip-flop circuit (FF) 20 is provided which is applied with a clock input comprising the calculation termination signal CF produced by WSG 19. The non-inverted output Q("1") is applied to a buffer memory section BM2 of a buffer memory device 27 to be described later to act as a write mode signal Q, whereas the inverted output ("0") of the flip-flop circuit 20 is applied to another buffer memory section BM1 to act as a write mode signal $\overline{Q}$, the former write mode signal Q becoming "0" when the flip-flop circuit 20 is reset by the key-on pulse KONP.

Figure 3:
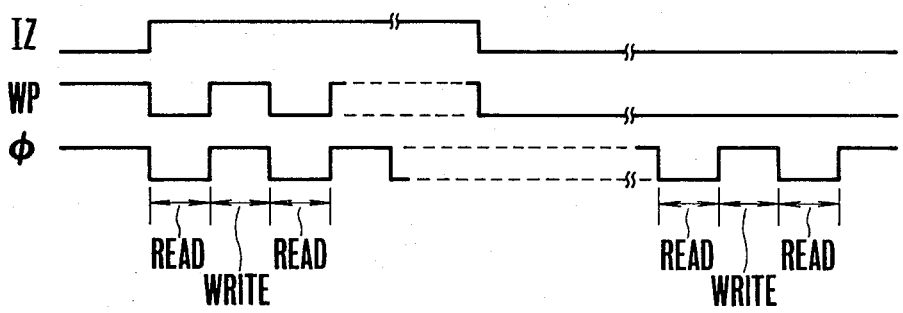
FIG. 3 is a time chart for explaining the manner of operation of the waveshape memory device shown in FIG. 1.

There are also provided a selector 21 which selects the address signal NA inputted to input B from the WSG 19 when the initial signal IZ produced by the WSG 19 when it is "1" whereas when the initial signal IZ is 0, selecting the address signal UA applied to input A from the address signal generator 16; a selector 22 which selects and produces an address signal NA inputted to input A when either one of the write mode signal $\overline{Q}$ and the initial signal IZ which are applied through an OR gate circuit 23 is "1", whereas selects and produces an address signal UA inputted to input B when both of the write mode signal $\overline{Q}$ and the initial signal IZ are "0"; a selector 24 which selects and produces the address signal NA inputted to input B when the write mode signal Q is "1", whereas selects and produces the address signal UA being applied to input B when the write mode signal Q is "0"; and the waveshape memory device 25 which operates in a read mode when a signal supplied to its read-write control terminal R/W is "1" to read out the sampling point amplitude value of one period of a musical tone waveshape to be generated. The writing of the waveshape memory device 25 is made into an address thereof designated by an address signal UA or NA from the selector 21, and the data input at the time of writing is supplied from a selector 37 to be described later. A read-write control circuit 26 is provided to control the read-write operation of the waveshape memory device 25. The read-write control circuit 26 comprises an AND gate circuit **26*b* which is enabled when an inverted writing pulse $\overline{WP}$ obtained by inverting the writing pulse WP by an inverter 26*a*** and when the initial signal IZ is "1", an AND gate circuit 26*d* which is enabled when an inverted initial signal $\overline{IZ}$ obtained by inverting the initial signal IZ by on inverter 26*c* and when the inverted clock pulse $\overline{\phi}$ is "1", and an OR gate circuit 26*e* which is supplied with "1", output signals of the AND gate circuits 26*b* and 26*d* to send its output "1" to the waveshape memory device 25 to act as a read-write control signal RW. Since the waveshape memory device 25 operates in the read mode when the signal applied to its read-write control terminal R/W is "1", as shown in the time chart shown in FIG. 3, when either one of the AND gate circuits 26*b* and 26*d* is enabled, the waveshape memory device 25 operates in the read mode, whereas when both of the AND gate circuits are disabled, the waveshape memory device 25 operates in the write mode. Thus, the modes alternately vary at each one half period of the writing pulse WP or the clock pulse $\phi$. More particularly, the content of the waveshape memory device 25 is read out by the "0" signal of the writing pulse WP or the clock pulse $\phi$ and a data of the musical tone waveshape to be generated next time is supplied by the next "1" signal to the memory address whose content has been read out. The data of the musical tone waveshape to be generated next time is supplied from a selector 37 to be described later, whereas the first musical tone waveshape data immediately following the depression of a key is applied from the WSG 19 through the selector 37. For the second and the following musical tone waveshape data, corrected musical tone waveshape data SD obtained by correcting present musical tone waveshape data UD in accordance with the amplitude difference between the new musical tone waveshape data ND momentarily stored in the buffer memory device 27 and musical tone waveshape data UD now being generated, is applied through the selector 37.

The buffer memory device 27 is used to temporarily store the new musical tone waveshape data calculated by WSG 19 and constituted by two buffer memory sections BM1 and BM2 which alternately operate in a read mode and in a write mode. The buffer memory section BM1 is constructed such that it operates in the write mode when the initial signal IZ and the write pulse WP applied to the AND gate circuit 27*b* are both "1", or the write mode signal $\overline{Q}$ and the write pulse WP applied to the AND gate circuit 27*c* are both "1". The writing data input terminal DI of the memory section BM1 is connected to receive the new musical tone waveshape data ND produced by WSG 19 whereas the address signal input terminal ADR is connected to receive an address UA or NA produced by the selector 22. Similar to the memory section BM1, the other buffer memory section BM2 is constructed such that it becomes the write mode when the signal applied to its read-write control terminal (R/W) via an OR gate signal 27*d* is "1", that is when the initial signal IZ and the writing pulse WP applied to an AND gate circuit 27*e* are both "1" or when the write mode signal Q and the writing pulse WP applied to an AND gate circuit 27*f* are both "1". The writing data input terminal DI of this buffer memory section BM2 is connected to receive a new musical tone waveshape data ND produced by WSG 19, while its address signal input terminal ADR is connected to receive an address signal UA or NA produced by the selector 24. Accordingly, when the initial signal IZ is "1", the new musical tone waveshape data ND is written into the memory addresses designated by the address signal NA of both memory sections BM1 and BM2 of the buffer memory device 27. After the initial signal IZ has become to "0", and when the write mode signal Q is "1", the buffer memory section BM2 operates in the write mode, whereas the other buffer memory section BM1 operates in the read mode, and when the write mode signal Q becomes "0" the operation modes of these two buffer memory sections BM1 and BM2 are reversed. In other words, in the buffer memory device 27 after the writing operation of the first new musical tone waveshape data ND has been completed, writing and reading of the new musical tone waveshape data ND are repeated alternately by the buffer memory sections BM1 and BM2.

There are also provided a selector 28 which selects the data read out from the buffer memory section BM1 and is applied to its input A when the write mode signal Q is "1", whereas when the write mode signal Q is "0" it selects the data read out from the buffer memory section BM2 and supplied to its input B; a latch circuit 29 which latches the musical tone waveshape data UD now to be generated and read out from the waveshape memory device 25 when the inverted clock pulse $\overline{\phi}$ is "1" and a subtracting circuit 30 which calculates the amplitude difference between the present musical tone waveshape data UD and the new musical tone waveshape data ND selected and produced by the selector 28 for producing difference information S. The subtracting circuit 30 comprises a subtractor 30*a* and an OR gate circuit 30*b* which produces a coincidence signal $\overline{EQ}$("0") when the difference information S becomes [0] (UD-32 ND). The subtractor 30*a* produces an encoded sign signal SB which becomes "0" when (ND−UD)>0, whereas becomes "1" when (ND−UD)<0.

A hold circuit 31 is provided for temporarily storing the renewal rate correction information CR produced by WSG 9 until the calculation regarding the next new musical tone waveshape data ND completes. The hold circuit 31 comprises a selector 31*a* which selects the renewal rate correcting information CR supplied to its input B from the WSG 19 when the calculation termination signal CF is "1", whereas selects the output of the register 31*b* when the calculation completion signal CF is "0", and a register 31*b* which is set with the output of the selector 31*a* in accordance with the clock pulse $\phi$. Further, a renewal rate control circuit 32 is provided for producing a waveshape renewal signal CA having a period corresponding to the difference information S produced by the subtracting circuit 30 and the renewal rate correction information CR produced by the hold circuit 31. The renewal rate control circuit 32 comprises a logarithm converter 32*a* which converts the difference information S into a logarithmic value log S, an adder 32*b* which adds the logarithmic difference information log S to the renewal rate correction information CR for producing the sum as the renewal rate information L, and a renewal signal generator 32*c* which produces a waveshape renewal signal CAW having a period corresponding to the renewal rate information L.

Figure 4:
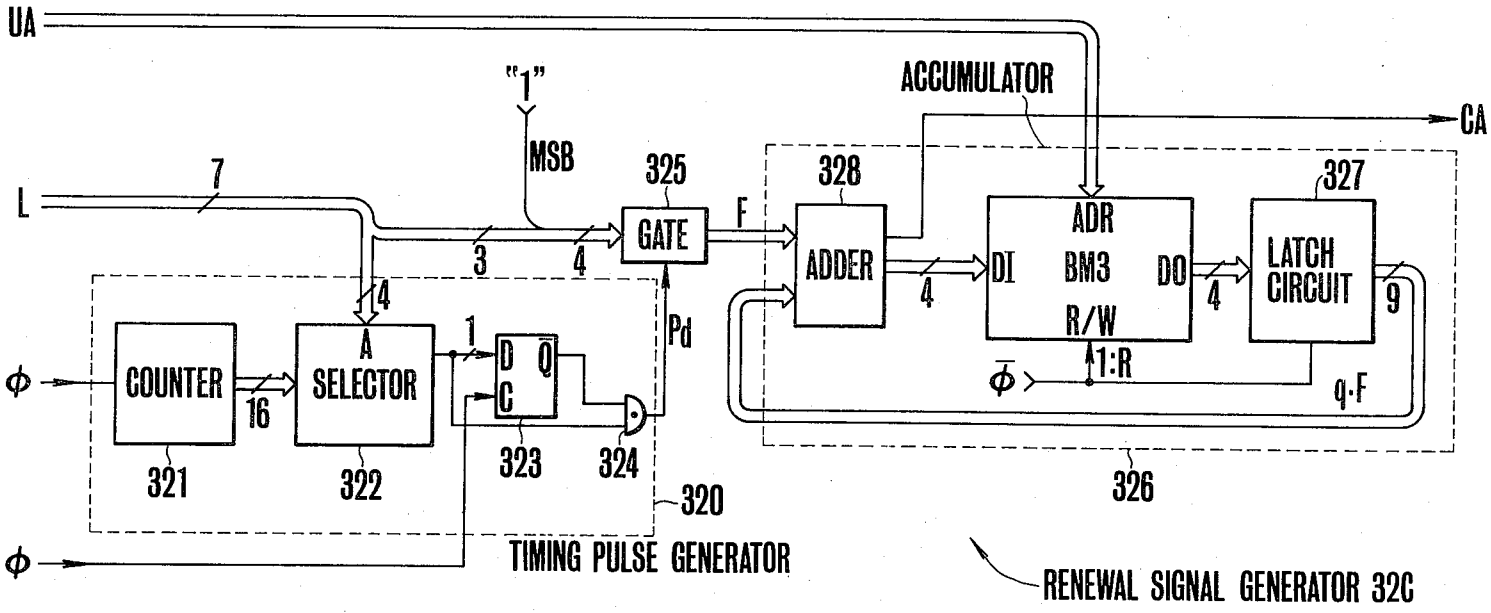
FIG. 4 is a connection diagram showing one example of the renewal signal generator shown in FIG. 1.

In this case, the renewal rate information L comprises 7 bits, for example, each bit being applied with a weight corresponding to the decibel value as shown in the following Table 1. The renewal signal generator 32*c* of the renewal rate control circuit 32 is constructed to produce the waveshape renewal signal CA of a period corresponding to the 7 bit renewal rate information L weighted corresponding to the decibel value. One example of the renewal signal generator 32*c* is illustrated in FIG. 4.

TABLE 1

| dB | MSB 48 | 24 | 12 | 6 | 3 | 1.5 | LSB 0.75 | |
|---|---|---|---|---|---|---|---|---|
| | 0 | 0 | 0 | 0 | 0 | 0 | 0 | 0dB |
| | 0 | 0 | 0 | 0 | 0 | 0 | 1 | 0.75dB |
| | 0 | 0 | 0 | 0 | 0 | 1 | 0 | 1.5dB |
| | . | . | . | . | . | . | . | . |
| | . | . | . | . | . | . | . | . |
| | . | . | . | . | . | . | . | . |
| | 0 | 0 | 0 | 1 | 0 | 0 | 0 | 6dB |
| | 0 | 0 | 1 | 0 | 0 | 0 | 0 | 12dB |
| | . | . | . | . | . | . | . | . |
| | . | . | . | . | . | . | . | . |
| | . | . | . | . | . | . | . | . |
| | . | . | . | . | . | . | . | . |
| | 1 | 1 | 1 | 1 | 1 | 1 | 1 | 95.25dB |

value as above described. Accordingly, when the values expressed by the lower 3 bits are linear they are expressed by $2^{\frac{1}{2}}$(3 dB), $2^{\frac{1}{4}}$(1.5 dB) and $2^{\frac{1}{8}}$(0.75 dB). In order to convert values which vary exponentially into values which vary linearly, it is necessary to add an "1" ($2^0$) as an upper bit to the lower 3 bits thereby obtaining values which vary substantially linearly, as shown in the following Table 2. In the following description, the quasi linear information produced by linearizing the lower 3 bits of the renewal rate information is called an F value, and the value shown by upper 4 bits of the renewal rate information is called a P value.

TABLE 2

| lower 3 bits of L | | | F value MSB | | | LSB | | |
|---|---|---|---|---|---|---|---|---|
| 3dB | 1.5dB | 0.75dB | $2^0$ | $2^{-1}$ | $2^{-2}$ | $2^{-3}$ | decimal value | (ideal decimal value) |
| 0 | 0 | 0 | 1 | 0 | 0 | 0 | 1.000 | (1.0000) |
| 0 | 0 | 1 | 1 | 0 | 0 | 1 | 1.125 | (1.0905) |
| 0 | 1 | 0 | 1 | 0 | 1 | 0 | 1.250 | (1.1892) |
| 0 | 1 | 1 | 1 | 0 | 1 | 1 | 1.375 | (1.2968) |
| 1 | 0 | 0 | 1 | 1 | 0 | 0 | 1.500 | (1.4142) |
| 1 | 0 | 1 | 1 | 1 | 0 | 1 | 1.625 | (1.5422) |
| 1 | 1 | 0 | 1 | 1 | 1 | 0 | 1.750 | (1.6818) |
| 1 | 1 | 1 | 1 | 1 | 1 | 1 | 1.875 | (1.8340) |

As shown in FIG. 4, the renewal signal generator 32c comprises a timing pulse generator 320 which generates a timing pulse Pd having a period designated by a combination of upper order 4 bits corresponding to decibel values larger than 6 dB of the renewal rate information L. The timing pulse generator 320 is constituted by a 16 bit binary counter 321 which counts the number of the clock pulses $\phi$ to produce pulse signals P0 (corresponds to $2^0$, $\phi$) through P15 (corresponds to $2^{15}.\phi$) having 16 pulse periods of $2^0.\phi$, $2^1.\phi$, $2^2.\phi \ldots 2^{15}.\phi$, a selector 322 which selects one of the pulse signals P0–P15 produced by the binary counter 321 and designated by a combination of upper 4 bits of the renewal rate information L, a flip-flop circuit 323 which latches the pulse signal (one of P0–P15) selected by the selector 322 at the rising portion of the clock pulse $\phi$, and an AND gate circuit 324 enabled by an inverted output Q of the flip-flop circuit 323, and the output of the selector 322. The flip-flop circuit 323 and the AND gate circuit 324 constitute a differentiating circuit which differentiates the rising portion of the pulse signal (P0–P15) produced by the selector 322. For this reason, the timing pulse generator 320 produces a timing pulse Pd having the same pulse width as the clock pulse $\phi$, and a period designated by a combination of the upper 4 bits of the renewal rate information L. The period of the timing pulse Pd becomes shorter as the value represented by the upper 4 bits of the renewal rate information L increases. In other words, the frequency of the timing pulse increases with the change of the renewal rate information L exponentially as once, twice, four times, eight times . . . . A gate circuit 325 passes information consisting of 4 bits which is formed by adding an upper bit of "1" to the lower 3 bits of the renewal rate information L each time the timing pulse Pd is generated. The reason for adding "1" upper bit to the lower three bits of the renewal rate information L is to convert the value shown by the lower 3 bits into a quasi linear information which varies substantially linearly. In other words, each bit of the renewal rate information L is applied with a weight corresponding to the decibel An accumulator 326 is provided to sequentially accumulate the F values which are applied thereto through a gate circuit 325 each time the timing pulse Pd is generated, thus producing the waveshape renewal signal CA having a period corresponding to the renewal rate information L. The accumulator 326 comprises an adder 328 which adds together the F value produced by the gate circuit 325 and the accumulated value q·F (q=1,2,3 . . . ) of the F value latched by a latch circuit 327 when the clock pulse $\overline{\phi}$ is "1", and a buffer memory device BM3 which stores the output of the adder 328 in its memory address designated by the address signal UA. The buffer memory device BM3 has the same number of memory addresses as the waveshape memory device 25 and the buffer memory sections BM1 and BM2 described above. When a signal "1" is applied to its read-write control terminal R/W, it operates in a read mode so that the content qF read out from the buffer memory device BM3 will be latched by the latch circuit 327. At this time, since the F value, or the renewal rate information L corresponds to the difference information between the sampling point amplitude values of the present musical tone waveshape and the new musical tone waveshape respectively read out from the waveshape memory device 25 and the buffer memory section BM1 (or BM2) designated by the address signal UA, F value corresponding to amplitude difference information between the present musical tone waveshape and the new musical tone waveshape at each sampling point will be stored in the buffer memory device BM3 of the accumulator 326.

The F value thus stored at each sampling point is added to a new P value corresponding to the same sampling point during the next waveshape read out cycle at a period of generation of timing pulse Pd. Since the period of the timing pulse Pd becomes shorter as the value of the above described P increases, the larger is the difference between the amplitude values of the present musical tone waveshape and the new musical tone waveshape at each sampling point, the larger will be the increasing rate of the accumulated value qF of the F value. In other words, carry signals will be produced by the adder 328 at a higher rate as the amplitude difference between the present musical tone waveshape and the new musical tone waveshape at each sampling point increases. Moreover, since the period of the timing pulse Pd varies exponentially with respect to the variation in the P value, the period of this carry signal varies also exponentially with respect to the variation in the P value. In other words, in the renewal signal generator 32*c*, the renewal rate information L weighted by a decibel value is converted into a signal of a period corresponding to a linearized value of the information L. Consequently, by utilizing a carry signal produced by the adder 328 of the renewal signal generator 32*c* as the waveshape renewal signal CA, when transferring from the present musical tone waveshape to the new musical tone waveshape, the transfer is made quickly at a sampling point where the amplitude difference is large, whereas slowly at a sampling point where the amplitude value is small, thereby smoothly changing the musical tone waveshape as a whole.

Referring again to FIG. 1, an adder 33 is provided to add a predetermined definite value [+1] or [−1] determined by a coincidence signal $\overline{EQ}$ (which is "0" at the time of coincidence) and the sign signal SB both produced by the subtractor 30*a*, to the sampling point amplitude value of the present musical tone waveshape produced by the latch circuit 29 at a period of the waveshape renewal signal CA. When the coincidence signal $\overline{EQ}$ is "1" and the sign signal SB is "0" (ND−UD>0), that is when the present musical tone waveshape data UD is smaller than the new musical tone waveshape data ND, AND gate circuit 34 is enabled to apply [+1] to the adder 33 each time the waveshape renewal signal CA is generated. On the other hand when the coincidence signal EQ is "1" and the sign signal SB is also "1" (ND−UD<0) that is when the present musical tone waveshape data UD is larger than the new musical tone waveshape data ND, AND gate circuit 35 is enabled to apply its output [−1] to the adder 33 each time the waveshape renewal signal CA is produced.

When the present musical tone waveshape data UD coincides with the new musical tone waveshape data ND, the coincidence signal $\overline{EQ}$ becomes "0" thus disabling both AND gate circuits 34 and 35. For this reason, the adder 33 produces the present musical tone waveshape data UD from the latch circuit 29 without any change. 36 represents an inverter for inverting the sign signal SB.

Furthermore, a selector 37 is provided which selects the new musical tone waveshape data ND applied to its input B from the WSG 19 when the initial signal IZ is "1", whereas when the initial signal IZ is "0" it selects a corrected musical tone waveshape data SD obtained by adding [+1] or [−1] to the present musical tone waveshape data UD, thus supplying the selected data to the data input terminal DI of the waveshape memory device 25.

There are also provided a D-A converter 38 which converts the present musical tone waveshape data UD produced from the latch circuit 29 to a corresponding analogue musical tone signal, and a sound system 39 which converts the musical tone signal from the D-A converter 38 into a musical tone.

The electronic musical instrument described above operates as follows. After a desired tone has been selected by the tone color selector 14, when the player depresses a key on the keyboard, the key switch circuit 11 sends to the address signal generator 16 the key information KD corresponding to the depressed key and also produces a key-on pulse KONP showing that one of the key has been depressed. Then, the address signal generator 16 sequentially accumulates the frequency information corresponding to the key information KD with the period of generation of the clock pulse $\phi$ so as to produce the accumulated value qR as the address signal UA.

After being reset by the key-on pulse KONP, the timer 5 counts the number of the clock pulses $\phi$ and sends its count to #2 parameter memory device 18 to use it as the timer signal T (T1, T2 . . . shown in FIG. 2). The tone color selector 14 sends the tone color selection signal TS selected by the player to the #1 and #2 parameter memory devices 17 and 18. Then parameter information P1 stored in a memory address corresponding to color selection signal TS is read out from the #1 parameter memory device 17 for calculating the musical tone waveshape. On the other hand, parameter information P2 (waiting time information WT, time-changing parameter information PT for musical tone waveshape calculation, renewal rate correction information CR) which has been stored in a memory address corresponding to a color selection signal TS is read out from of a memory block corresponding to timer signal T of #2 parameter memory device 18. These read out parameter information P1 and P2 are supplied to WSG 19 to calculate a new musical tone waveshape data ND based on P1 and P2 (interval t1–t2 shown in FIG. 2). Upon completion of the new musical tone waveshape data ND (at time t2, FIG. 2), and after the elapse of time corresponding to the waiting time interval contained in the parameter information P2 (at time t3, in FIG. 2) the WSG 19 produces calculation termination signal CF, initial signal IZ, and renewal rate correction signal CR, and also successively produces address signal NA representing the memory address of the new musical tone waveshape data ND, and writing pulse WP.

Among the information thus produced by the WSG 19, the renewal rate correction information CR is stored temporarily in register 31*b* via the selector 31*a* of the hold circuit 31. Since the initial signal IZ is being produced, the new musical tone waveshape data ND is applied to the data input terminal DI of the waveshape memory device 25 via selector 37 and also to the data input terminals DI of the buffer memory sections BM1 and BM2 of the buffer memory device 22. Since the flip-flop circuit 20 has been set by the calculation termination signal CF so that its wire mode signal Q is "1" and since the initial signal IZ is "1", the address signal NA is inputted to the address signal input terminals ADR of the waveshape memory device 25 and buffer memory sections BM1 and BM2 respectively through selectors 21, 22 and 24. In this manner, the first new musical tone waveform data ND is written into successive addresses designated by the address signal NA of the buffer memory sections BM1 and BM2 and of the waveshape memory device 25 at each generation of the writing pulse WP. Thus, the new musical tone waveshape data ND is successively written in the memory addresses of the waveshape memory device 25 designated by the address signal NA each time the writing pulse WP is generated, but since the read-write control signal RW produced by the read-write control circuit 26 cyclically changes as "1"→"0"→"1"→"0"→ the waveshape memory device 25 will be read mode while the read-write control signal RW is "1" so as to read out the musical tone waveshape data which has been stored in the memory address designated by the address signal NA as the present musical tone waveshape data UD, whereas the waveform memory device 25 will operate in the write mode while the read-write control signal RW is "0" so as to write the new musical tone waveshape data ND. Accordingly, during the first writing cycle of the musical tone waveshape, a musical tone waveshape corresponding to a key depressed previous to the key new being depressed is sequentially read out from the waveshape memory device 25. For this reason, a small building-up portion of the musical tone generated by a key depressed at this time would be affected by the previous musical tone waveshape. However, such effect can be ignored because it occurs during only a short interval in one write-read cycle.

When all of the new musical tone waveshape data ND produced by WSG 19 are written in the waveshape memory device 25 and the buffer memory sections BM1 and BM2, WSG 19 makes "0" the initial signal IZ (at time t4, FIG. 2) and then the musical tone waveshape calculating parameter P1 and parameter information P2 corresponding to a change timer signal T are read out from the parameter memory devices 17 and 18 respectively, and then the calculation of a new musical tone waveshape data to be generated next time is commenced.

When the initials signal IZ becomes "0", selectors 21 and 22 select the address signal UA generated by the address signal generator 16 and supply the selected address signal to the waveshape memory device 25, and the buffer memory section BM1 respectively as an address signal. Then, the new musical tone waveshape data ND, now acting as the present musical tone waveshape data UD, which is calculated by WSG 19 immediately after the key depression, that is the musical tone waveshape data stored in a memory address designated by the address signal UA is read out from the waveshape memory 25 while the clock pulse $\phi$ is "0". More particularly, the new musical tone waveshape data ND calculated by WSG 19 immediately after the key depression is sequentially read out as the present musical tone waveshape data UD.

On the other hand, in the buffer memory section BM1, since the writing mode signal $\overline{Q}$ applied to the AND gate circuit 27c at this time is "0" this memory section is in the read mode. Accordingly, in the buffer memory section BM1 too, the new musical tone data ND calculated by WSG 19 immediately after the key depression is sequentially read out from a memory address designated by the address signal UA, and the read out data is sent to the subtractor 30 via selector 28.

The present musical tone waveshape data UD read out from the waveshape memory device 25 during the "0" interval of the clock pulse $\phi$ is firstly latched by the latch circuit 29 and then converted into an analogue musical tone signal by D-A converter 38. At this time, in a memory address of the waveshape memory device 25 from which the present musical tone waveshape data UD has already been read out is written which the clock pulse $\phi$ is "1" the corrected musical tone waveshape data SD prepared by correcting the present musical tone waveshape data UD latched in the latch circuit 29. More particularly, the present musical tone waveshape data UD latched by the latch circuit 29 is sent to subtractor 30 together with the new musical tone waveshape data ND read out from the buffer memory device BM1 by address signal UA which is also used for the waveshape memory device 25. The subtractor 30 calculates the difference between the two data, that is the amplitude difference. This difference information S is converted into logarithmic difference information log S by the logarithmic - linear converter 32a of the renewal rate control circuit 32 and then added to the renewal rate correction information CR by adder 32b. The output of this adder constitutes renewal rate information L applied to the renewal signal generator 32c. Then, this renewal signal generator produces the waveshape renewal signal CA having a period corresponding to the renewal rate information L in a manner as above described.

The waveshape renewal signal CA is applied to the inputs of AND gate circuits 34 and 35. At this time, when the difference information S is larger than zero, [+1] is added to the present musical tone waveshape data UD applied to the adder 33 from the latch circuit 29, whereas if $S<0$, [−1] will be added to the present musical tone wave data UD. The present musical tone waveshape data UD corrected with [+1] or [−1] with the adder 33 is fed back to the data input terminal DI of the waveshape memory device 25 via selector 37 to perform as a corrected musical tone waveshape data SD to be written in the memory device 25 while the clock pulse $\phi$ is "1". Since the present musical tone waveshape data UD seccessively read out from the waveshape memory device 25 and the new musical tone waveshape data ND successively read out from the buffer memory section BM1 concern the same musical tone waveshape data calculated by WSG 19 immediately after depression of a key, the subtractor 30 produces a coincidence signal $\overline{EQ}$ of "0". For this reason, the present musical tone waveshape data UD entering into adder 33 is written in the same address of the waveshape memory device 25 from which the data UD has been read out without being added with [+1] or [−1].

While the same musical tone waveshape is being transferred between the waveshape memory device 25 and the buffer memory section BM1, WSG 19 completes the calculation of the new musical tone waveshape data ND to be produced next time (at time t5, FIG. 2), and as an interval corresponding to the waiting time information WT contained in the parameter information P2 elapses (at time t6, in FIG. 2), WSG 19 produces calculation termination signal CF and renewal rate correction information CR and then sequentially produces the calculated new musical tone waveshape data ND in synchronism with the address signal NA and the writing pulse WP. Then, the flip-flop circuit 20 is reset by the calculation termination signal CF so that the write mode signal Q changes to "0" and signal $\overline{Q}$ to "1". The renewal rate correction information CR is temporarily stored in the register 31b via selector 31a. As the write mode signal $\overline{Q}$ changes to "1", the selector 22 selects the address signal NA produced by WSG 19 and supply it to the buffer memory section BM1 as an address signal. On the other hand, when the write mode signal Q changes to "0", the selector 24 select the signal UA produced by the address signal generator 16 and applies it to the buffer memory section BM2 as an address signal.

The AND gate circuit 27c in the buffer memory device 27 is enabled thus turning the buffer memory section BM1 into the write mode. On the other hand, the AND gate circuit 27f is disabled to turn the buffer memory section BM2 into the read mode. Consequently new musical tone waveshape data calculated by WSG 19 at the second time is sequentially written into the buffer memory section BM1. Now the transfer of the musical tone waveshape data is performed between the waveshape memory device 25 and the buffer memory section BM2. At this time, since the new musical tone waveshape data to be stored in the waveshape memory device 25 and the buffer memory section BM2 concerns the same musical tone waveshape data calculated by the WSG 19 during the first calculation cycle, not corrected musical tone waveshape data UD will be stored again in the waveshape memory device 25 in a similar manner to the data transfer between the same and the buffer memory section BM1.

Figure 5:
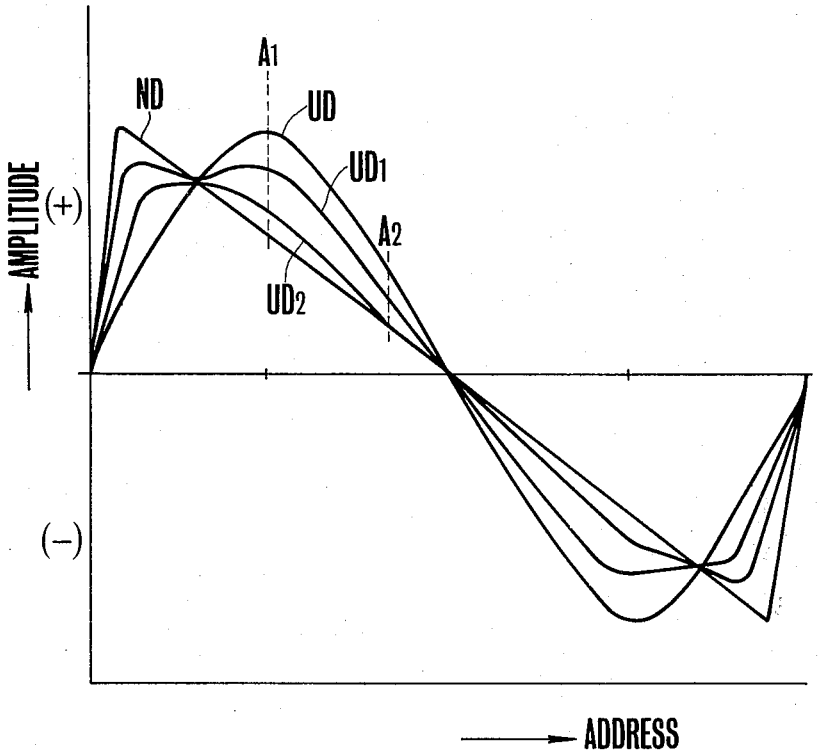
FIG. 5 is a graph useful to explain the operation of the electronic musical instrument at the time of renewal of a musical tone waveshape.

Thereafter, when WSG 19 completes the third new musical tone waveshape data ND and produces a calculation termination signal CF (at time t7, FIG. 2), the flip-flop circuit 20 is set, whereby the write mode signal Q becomes "1", whereas the signal $\overline{Q}$ becomes "0". Then, the buffer memory section BM1 is turned into the read mode to sequentially read out the second new musical tone waveshape data ND according to the address signal UA. Suppose now that, the new musical tone waveshape data ND produced by calculating the second new musical tone waveshape data ND and written into the buffer memory section BM1 corresponds to a musical tone waveshape ND shown in FIG. 5, and that the present musical tone waveshape data UD written into the waveshape memory device 25 corresponds to a musical tone waveshape UD shown in FIG. 5, then these data ND and UD are sequentially read out by the address signal UA and applied to the subtractor 30*a*. Then the subtractor 30*a* sequentially calculates the amplitude difference between the present musical tone waveshape data UD and the new musical tone waveshape data ND thereby producing difference information S, which is converted into logarithmic difference information log S by the logarithmic-linear converter 32*a* and then added to the renewal rate correction information CR in the adder 32*b*. Then the adder 32*b* sends its sum to the renewal signal generator 32*c* to act as renewal rate information L. Assume now that the amplitude difference between the present musical tone waveshape data UD and the new musical tone waveshape data ND which are stored in an address shown by A1 in FIG. 5 corresponds to 48dB, for example, that the amplitude difference between the present musical tone waveshape data UD and the new musical tone waveshape data ND which are stored in an address shown by A2 in FIG. 5 corresponds to 6dB, and that the renewal rate correction information CR is 0dB, then the renewal signal generator 32*c* will produce a waveshape renewal signal CA having a period corresponding to 48dB at a point A1 where the address signal UA is generated and produce a waveshape renewal signal CA of a period corresponding to 6dB at a point A2 where the address signal UA is generated. More particularly when the present musical signal waveshape data UD and the new musical tone waveshape data ND stored in the address designated by A1 are read out, the renewal signal generator 32*c* produces a waveshape renewal signal CA having a period corresponding to $2^3 \cdot \phi$ while at the time of address A2, produces a waveshape renewal signal CA of a period corresponding to $2^0 \cdot \phi$. Then in the case of address A1, the amplitude value of the present musical tone waveshape data UD is larger than tht of the new musical tone waveshape data ND so that the sign signal SB produced by subtractor is "1" (which means negative), whereby an addition input of [−1] is inputted to adder 33 at a period of $2^3 \cdot \phi$. Accordingly, the present musical tone waveshape data UD in address A1 is rewritten into a musical tone waveshape as shown by UD1 in FIG. 5 with a period of $2^3 \cdot \phi$. Thereafter the data UD is sequentially rewritten as UD2 . . . ND. Furthermore, the present musical tone waveshape data UD stored in the address designated by A2 is sequentially renewed to the new musical tone waveshape data ND with a period of $2^0 \cdot \phi$. In this manner, where the amplitude difference between the present musical tone waveshape data UD and the new musical tone waveshape data ND is large, the frequency of generation of the waveshape renewal signal CA increases with the result that [+1] or [−1] will be frequently added to the present musical tone waveshape data UD and the sum is written again in the waveshape memory device 25. In other words, where the amplitude difference between the present musical tone waveshape data UD and the new musical tone waveshape data ND is large, the content of the waveshape memory device 25 is quickly renewed to the new musical tone waveshape data ND, whereas where the amplitude difference is small, the content is slowly renewed to the new musical tone waveshape data ND thus smoothly switching the musical tone waveshapes. The amount of variation by which the present musical tone waveshape data UD is renewed to the new musical tone waveshape data ND at each generation of the waveshape renewal signal CA, is [+1] or [−1]. However, it will be readily understood that the renewal rate can be increased by increasing this amount. Furthermore, it is possible to vary as desired the renewal rate by controlling the renewal rate correction information generated by WSG 19. Consequently, in the electronic musical instrument illustrated in the embodiment, it is possible to smoothly switch the present musical tone waveshape to the new musical tone waveshape thus eliminating the click noise at the time of switching. Moreover, as it is possible to freely control the renewal rate of the musical tone waveshape it is also possible to freely control the tone color change at the time of renewal. Further, in this embodiment, since the parameter information P2 (waiting time information WT, time-variation parameter information PT for musical tone waveshape calculation and renewal rate correction information CR) read into the WSG 19 varies with time, the interval in which the present musical tone waveshape is switched to the new musical tone waveshape, and the shape and amplitude of the musical tone waveshape also vary with time whereby the tone color of the generated musical tone can also be varied with time. The manner of varying with time the generated musical tone corresponds to the tone selected by the tone color selector 14. Thus, alteration of the selected tone color selected by the tone color selector 14 not only changes the tone color of the generated musical tone but also changes the manner of variation with time of the newly generated musical tone.

Although in this embodiment, the musical tone waveshape data corresponding to the previous key depression is read out from the waveshape memory device 25 till the first new musical tone waveshape data immediately following the new key depression is written into the waveshape memory device 25, it is possible to easily remove the effect of the operation of the previous key upon the newly generated musical tone by preventing the latch circuit 29 from producing an output while the initial signal IZ is "1".

It should be also understood that the amplitude envelope of a desired waveshape as attack, sustain, decay and release may be imparted to the present musical tone waveshape UD successively read out from the waveshape memory device 25 as is well known in the art.

Although above description related to a monophonic electronic musical instrument, it may be constructed as polyphonic type by constructing the address signal generator 16, etc. to include a key assigner.

As above described, according to the electronic musical instrument of this invention, renewal of the present musical tone waveshape with a new musical tone waveshape is effected by a waveshape renewal signal having a period corresponding to the amplitude difference between these new and present waveshapes at the sampling point. For this reason renewal of the musical tone waveshapes can be readily effected at a high speed without utilizing any multiplier. Moreover, it is also possible to control as desired the amplitude variation and the period of the waveshape renewal signal at the time of transferring from the present musical tone waveshape to the new musical tone waveshape so as to freely vary the tone color at the time of renewal of the waveshape. Especially, since the waveshape renewal signal of a frequency corresponding to the difference in the amplitude difference between the present and new musical tone waveshapes at respective sampling points is generated as a signal having a period corresponding to a value obtained by converting the amplitude difference information at each sampling point into a logarithmic value and then converting the same into a linear quantity, the renewal is made quickly at sampling points where the amplitude difference is large whereas slowly at sampling points where the amplitude difference is small, whereby it is possible to effect smooth renewal of the musical tone waves. Furthermore, it is possible to control as desired the renewal time by changing the period of the waveshape renewal signal or by suitably modifying the width of variation at the renewal of the present musical tone waveshape to the new musical tone waveshape. The change of the period of the waveshape renewal signal can be readily made by converting into a logarithmic value the amplitude difference iformation corresponding to the amplitude difference between the present and new musical tone waveshapes at respective sampling point, and then adding the amplitude difference information converted into the logarithmic value to any renewal rate corretion information applied externally.

What is claimed is:

1. An electroic musical instrument wherein a musical tone is generated by repeatedly reading out amplitude values at sampling points in one period of a musical tone waveshape stord in a first waveshape memory device at a period corresponding to a tone pitch of a depressed key, said electronic musical instrument comprising;

a second waveshape memory device for storing amplitude values at sampling points in one period of a new musical tone waveshape to be generated subsequent to said musical tone waveshape stored in said first waveshape memory device;

first calculating means for calculating differences in amplitude values at sampling points stored in corresponding addresses of said first and second waveshape memory devices respectively;

renewal rate control means for generating a waveshape renewal signal having a period corresponding to difference information produced by said first calculating means; and renewal means for effecting renewal of the memory content of said first waveshape memory device at a speed corresponding to the period of said waveshape renewal signal.

2. An electronic musical instrument according to claim 1 wherein said renewal means comprises second calculating means for performing either addition or subtraction on an output read out from said first waveshape memory device and a predetermined constant representing a width of variation at the time of waveshape renewal, and means for sending a result of calculation of said second calculating means to said first waveshape memory device as a new memory content thereof.

3. An electronic musical instrument according to claim 1 or 2 wherein said second waveshape memory device comprises two waveshape memory sections, means for operating said waveshape memory sections alternately in a read out mode and a write mode, and means for storing the amplitude values of sampling points in one period of a new musical tone waveshape to be generated next time in one of said waveshape memory sections while the memory content of said first waveshape memory device is being renewed in accordance with an output read out from the other waveshape memory section in the read out mode.

4. An electronic musical instrument according to claim 1 wherein said renewal rate control means comprises a logarithmic converter which converts the difference information from said first calculating means into a logarithmic value, and means for forming said renewal signal having a period corresponding to a value of a natural number obtained by converting an output of said logarithmic converter.

5. An electronic musical instrument according to claim 1 further comprising means for modifying said waveshape renewal signal.

6. An electronic musical instrument according to claim 5 wherein said renewal rate control means comprises a logarithmic converter which converts the difference information from said first calculating means into a logarithmic value to produce the same as a logarithmic difference signal, means for producing a renewal rate correction signal, an adder for adding said logarithmic difference signal to said renewal rate correction signal for producing renewal rate information in terms of a logarithmic value, and a renewal signal generator for producing said waveshape renewal signal having a period corresponding to a value of a natural number obtained by converting said renewal rate information produced by said adder.

7. An electronic musical instrument according to claim 6 wherein said renewal rate correction signal varies with time.

8. An electronic musical instrument according to claim 4 or 6 wherein said renewal signal generator comprises a multiple stage counter for counting reference pulses, a selector for selecting one output of said counter in accordance with a plurality of upper order bits of an output of said logarithmic converter, a converting circuit for converting lower order bits of the output of said logarithmic converter into linear data, and a circuit for accumulating said linear data with a period corresponding to the selected counter output.

9. An electronic musical instrument according to claim 2 wherein each of said waveshape memory devices comprises means for sequentially effecting reading out and writing operations for one address designation.

* * * * *

UNITED STATES PATENT AND TRADEMARK OFFICE

CERTIFICATE OF CORRECTION

PATENT NO. : 4,227,433

DATED : October 14, 1980

INVENTOR(S) : Masanobo Chibana

It is certified that error appears in the above—identified patent and that said Letters Patent is hereby corrected as shown below:

In the heading after the line "[22] Filed: Sept. 18, 1979", add the following:--

[30] Foreign Application Priority Data

September 21, 1978 [JP] Japan....115120/78

--

Signed and Sealed this

Second Day of June 1981

[SEAL]

*Attest:*

RENE D. TEGTMEYER

*Attesting Officer*

*Acting Commissioner of Patents and Trademarks*